United States Patent [19]

Zeimer

[11] 4,207,034

[45] Jun. 10, 1980

[54] PUMP WITHOUT MOTORIC DRIVE

[76] Inventor: Ran Zeimer, 126 Tzur Hadassa St., Mobile Post, Emek Haela, Israel

[21] Appl. No.: 898,204

[22] Filed: Apr. 20, 1978

[30] Foreign Application Priority Data

Apr. 25, 1977 [IL] Israel ..... 51936

[51] Int. Cl.[2] ..... F04B 17/00; F04B 43/06; F03G 7/02

[52] U.S. Cl. ..... 417/379; 417/395; 60/531; 60/641

[58] Field of Search ..... 417/379, 395, 207; 60/641, 531

[56] References Cited

U.S. PATENT DOCUMENTS

| | | | |
|---|---|---|---|
| 2,212,281 | 8/1940 | Ullstrand | 417/395 |
| 3,298,320 | 1/1967 | Latham, Jr. | 417/395 |
| 3,937,599 | 2/1976 | Thureau et al. | 417/379 X |

FOREIGN PATENT DOCUMENTS

| | | | |
|---|---|---|---|
| 158478 | 4/1957 | Sweden | 417/395 |
| 167508 | 6/1959 | Sweden | 417/395 |
| 174194 | 12/1960 | Sweden | 417/395 |

*Primary Examiner*—Leonard E. Smith
*Attorney, Agent, or Firm*—Sandler & Greenblum

[57] ABSTRACT

A heat operated pump comprising:

a boiler containing a driving fluid;

means for heating said driving fluid in said boiler;

condenser means;

a pumping chamber including a flexible partition sealingly disposed in said chamber to define first and second sealingly separated portions;

first inlet means defining a communication passage from the interior of said boiler to said first portion;

first exit means defining a communication passage between said first portion and said condenser means;

second inlet means providing a uni-directional flow-path from a source of fluid to be pumped to said second portion; and second exit means providing a uni-directional flow-path from said second portion to a fluid utilization location;

said pumping chamber, first exit means and flexible partition being configured together to define a valve permitting communication between said condenser means and said first portion only when the volume of said first portion exceeds a predetermined volume;

said condenser being maintained at a pressure less than the pressure of said fluid at said second inlet means.

6 Claims, 13 Drawing Figures

Fig. 8
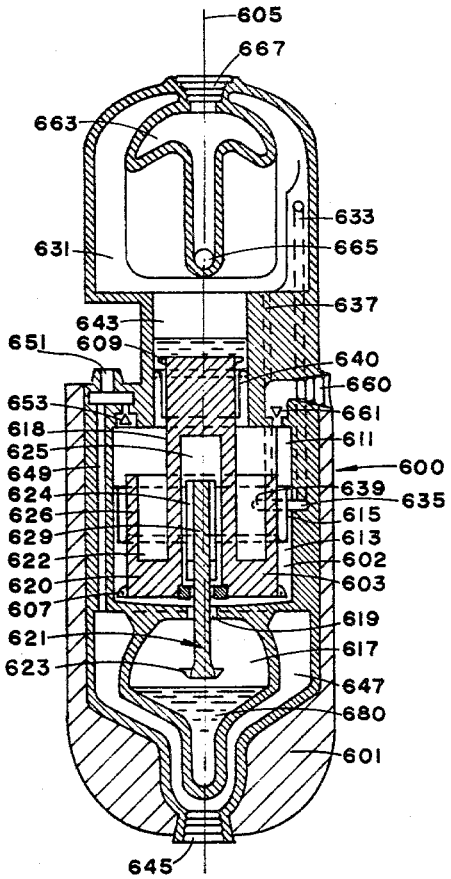
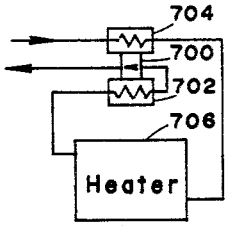
Fig. 9A
Fig. 9B
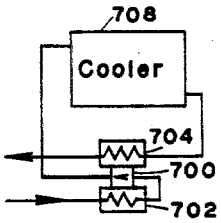
Fig. 6
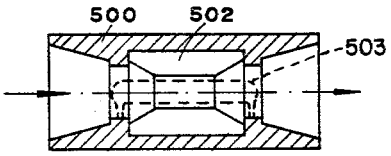
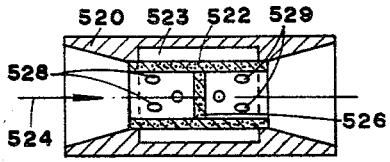
Fig. 7

PUMP WITHOUT MOTORIC DRIVE

FIELD OF THE INVENTION

The present invention relates to heat operated pumps and to fluid pumps generally.

BACKGROUND OF THE INVENTION

There are known a wide variety of applications in which it is desired to pump a fluid and where conventional sources of energy for driving a conventional pump are not available or are uneconomical. An example of such applications is a conventional solar water heater wherein water circulation therethrough is effected by a thermo-syphon system and often involves aesthetic difficulties, or by an electric pump which involves considerable expense, requires thermostatic control and renders the system dependent on the continuous supply of electrical current. Another example is the pumping of liquids such as oil or gas at remote locations where conventional energy sources are not available and where an extremely long maintenance-free lifetime is of primary importance.

A number of heat operated pumps have been proposed. One such proposal is found in U.S. Pat. No. 3,937,599 which shows a thermally-operated motor comprising a flexible membrane connected to a distributor which alternatively couples the volume adjacent one side of the membrane to a source of vapour and to a condenser.

The device shown in U.S. Pat. No. 3,937,599 is relatively complicated, involving a large number of interacting moving parts. It would, thus appear that the proposed device would require careful and timely maintenance to remain in operation.

The present invention seeks to overcome the disadvantages of prior art heat-operated pumps exemplified by the disclosure in U.S. Pat. No. 3,937,599 to provide a pump which requires relatively little maintenance due to the fact that it comprises a relatively small number of moving parts.

There is thus provided in accordance with an embodiment of the invention a heat operated pump comprising:

a boiler containing a driving fluid;

means for heating said driving fluid in said boiler;

condenser means;

a pumping chamber including a flexible partition sealingly disposed in said chamber to define first and second sealingly separated portions;

first inlet means defining a communication passage from the interior of said boiler to said first portion;

first exit means defining a communication passage between said first portion and said condenser means;

second inlet means providing a uni-directional flow-path from a source of fluid to be pumped to said second portion; and second exit means providing a uni-directional flow-path from said second portion to a fluid utilization location;

said pumping chamber, first exit means and flexible partition being configured together to define a valve permitting communication between said condenser means and said first portion only when the volume of said first portion exceeds a predetermined volume;

said condenser being maintained at a pressure less than the pressure of said fluid at said second inlet means.

The above mentioned objects of this invention, as well as its further objects, will now be described by way of example and with reference to the accompanying drawings in which:

FIGS. 6 and 7 are longitudinal sectional views of two variants of a flow stabilizer for use with a pump according to the present invention;

FIG. 8 is a longitudinal sectional view of a pump according to the present invention, designed to circulate a liquid through a heater and/or a cooler, the pumped liquid at its higher temperature operating as the source of heat required by the pump, and the same liquid at its lower temperature operating as the required sink;

FIG. 9A shows schematically a circuit comprising a heater and a pump according to the present invention, in which the pumped liquid operates after the heater as the source of heat required to the pump, and before the heater as the required sink;

FIG. 9B shows schematically a circuit comprising a cooler and a pump according to the present invention in which the pumped liquid operates before the cooler as the source of heat required to the pump, and after the cooler as the required sink;

FIG. 10 is a partially cutaway, exploded side view illustration of an experimental model of a pump constructed and operative in accordance with an embodiment of the invention;

FIG. 11 is a side view illustration of the pump of FIG. 10, and ;

FIG. 12 is a sectional illustration taken along the lines A—A of FIG. 11.

Figure 1:
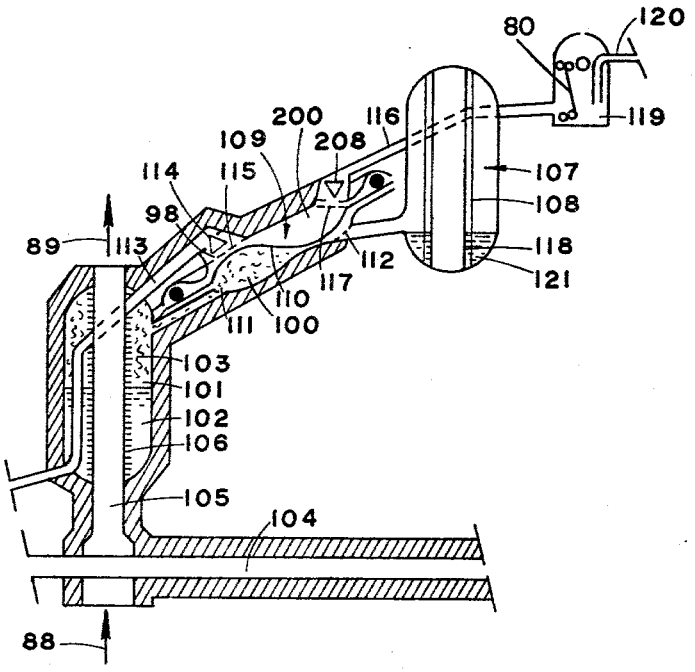
FIG. 1 shows schematically in sectional illustration a pump according to an embodiment of the present invention, in which fuel feeding an internal-combustion engine is the pumped liquid, the exhaust-pipe being the source of heat required by the pump, and the ambient air being the sink.

Reference will now be made to FIG. 1 of the drawings which illustrates in schematic form a pump constructed and operative in acordance with an embodiment of the invention and designed for use as a fuel pump in association with an internal-combustion engine. A boiler 101 contains a liquid 102 such as petroleum ether, which boils at sea level at about 50° C., and its vapour 103. A hollow heat exchanger tube 105, drawing air from the atmosphere, traverses the interior of boiler 101 and is arranged with its air inlet in thermal communication with the exhaust pipe 104 of the internal-combustion engine (not shown), such that the atmospheric air is heated prior to being passed through the boiler. Fins 106 are provided on the outer walls of heat exchanger tube 105 inside the boiler for enhancing heat transfer to the liquid 102 therein from the heated air passing through the tube.

A condenser 107, comprising a central heat exchanger tube 118 formed with radially extending longitudinal fins 108 is arranged to receive vapour 103 and contains at the bottom portion thereof the condensate 121 of vapour 103. Condenser 107 communicates with the interior of boiler 101 via a pumping chamber 109, divided by a flexible partition 110 into two portions of variable relative volume. A first portion 100, shown exemplarily in the drawing as the lower part of chamber 109 communicates with the interior of boiler 101 through an aperture 111. First portion 100 communicates with the interior of condenser 107 via an aperture 112. The second portion 200 of pumping chamber 109, here illustrated as the upper portion, communicates with an inlet conduit 113 via an aperture 115 and a one-way valve 114 which prevents outflow of fluid from portion 200 into conduit 113. Portion 200 similarly communicates with an outlet conduit 116 via an outlet aperture 117 and one-way valve 208 which prevents a return flow from outlet conduit 116 into portion 200.

Apertures 111, 112, 115 and 117 are typically covered with a screen mesh 98 to prevent excessive wear and damage to flexible partition 110 by possible cutting of the partition material by the edges of the apertures.

Alternatively, apertures 111, 112, 115 and 117 may be formed of a plurality of small holes.

In the exemplary embodiment described herein, inlet conduit 113 may be coupled to the fuel tank of a vehicle and outlet conduit 116 may conveniently communicate with an intermediate holding tank 119 which is in turn connected via an outlet tube 120 to an internal-combustion engine.

Operation of the pump described hereinabove in connection with FIG. 1 will now be summarized. The internal-combustion engine begins operation, fed with fuel stored in tank 119. Thereafter, exhaust pipe 104 reaches an elevated temperature and heats the surrounding air at the entrance to heat exchanger tube 105. The heated air passes through tube 105 in a direction indicated by arrows 88 and, by conduction through tube 105 aided by fins 106, heats liquid 102 inside boiler 101. Initially the pressures in boiler 101 and in condenser 107 are substantially equal and are selected to lie below atmospheric pressure, thus forcing the flexible partition 110 close to the bottom of the chamber such that portion 200 occupies substantially all of the volume of chamber 109 and draws fuel into portion 200, substantially filling it. Since flexible partition 110 lies along the bottom of chamber 109 and over screened aperture 111 and 112, it effectively closes apertures 111 and 112 until sufficient vapour pressure is generated to dislodge the partition.

As the liquid 102 in boiler 101 becomes hot, vapor 103 is generated thus increasing the vapor pressure in the boiler to a level sufficient to dislodge partition 110 from aperture 111, thus enabling vapor 103 to pass through aperture 111 into portion 100 of chamber 109. In the meantime, until the pressure in portion 100 reaches a predetermined level, aperture 112 remains closed by partition 110 thus permitting a pressure buildup in portion 100. As portion 100 becomes filled with vapor the flexible partition 110 is urged upwardly thus contracting the volume of portion 200. The fuel contained in the portion 200 is thus forced out of chamber 109 via aperture 117 and one-way valve 208 to tank 119. It is noted that backflow of the fuel from portion 200 to conduit 113 is prevented by the action of one-way valve 114.

Entry of fuel from outlet conduit 116 to tank 119 is governed by a float valve assembly 80 and is terminated when the fuel in tank 119 reaches a predetermined level.

At a point when the fuel is substantially expelled from chamber 109 and thus the flexible partition 110 is disposed in the uppermost portion of chamber 109, partition 110 moves away from aperture 112, thus opening the aperture and permitting the vapor 103 to pass from chamber portion 100 to condenser 107.

The vapor entering condenser 107 is cooled by means of atmospheric air or any other suitable fluid passing through heat exchanger tube 118. At a suitable condenser temperature below 50° C., the pressure inside the condenser remains lower than the pressure of the pumped fuel prior to entering chamber 109. Thus partition 110 is urged in the downward direction thereby drawing fluid into portion 200. The weight and pressure of the liquid contained in portion 200 forces partition 110 to its initial extreme lower position in which partition 110 closes apertures 111 and 112. The cycle described hereinabove is then repeated.

Condensate 121 is permitted to return to the boiler via portion 100 during the stage in the operation cycle when both apertures 111 and 112 are open.

In order to prevent condensation of vapour 103 on the flexible partiton 100, the pump fuel is pre-heated during its passage through the boiler 101 via tube 113.

Figure 2:
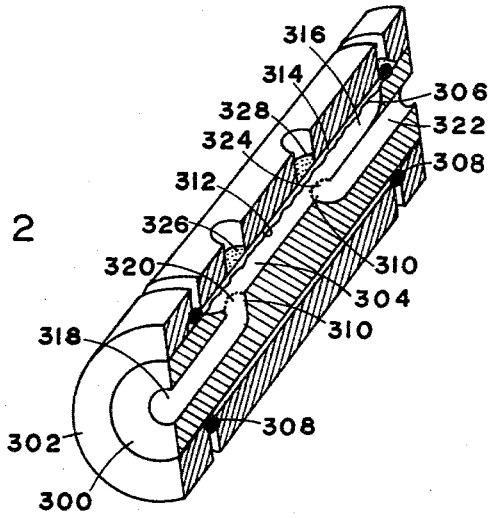
FIG. 2 is a perspective sectional view of a portion of pumping apparatus constructed and operative in accordance with an embodiment of the invention.

Reference is now made to FIG. 2 which illustrates in sectional pictorial form, pumping chamber 109 and the conduits leading therefrom to the various other components of the apparatus illustrated generally in FIG. 1. The pumping chamber may conveniently be formed of respective inner and outer coaxial cylindrical members 300 and 302. Inner cylinder 300 conveniently may be formed with a recess 304 which defines the pumping chamber analogous to chamber 109 of FIG. 1. A flexible partition member 306 is disposed over recess 304 and in sealing relationship between respective cylinders 300 and 302. Desired sealing at the periphery of partition 306 for the purpose of preventing leakage both between respective volumes lying above and below partition 306 and for preventing escape of liquid from recess 304 is provided by the provision of peripheral sealing rings 308. Rings 308 are disposed in peripheral grooves arranged transversely of the common axis of cylinders 300 and 302.

It is appreciated that flexible partition 306 may be disposed at any desired position intermediate extremes defined by the interior-most surface 310 formed in cylinder 300. The volume defined between partition 306 and surface 312 will henceforth be referred to as the liquid chamber 314 and the volume defined between partition 306 and surface 310 will henceforth be referred to as the vapor chamber 316.

Vapor chamber 316 is coupled to the boiler (not shown) by means of a vapor inlet conduit 318 and an inlet aperture 320. Vapor chamber 316 is also connected via a one-way valve (not shown) to a condenser (not shown) via a vapor exit conduit 322 and a vapor exit aperture 324.

Liquid chamber 314 is coupled to a source of liquid (not shown) via a check valve (not shown) and a liquid inlet aperture 326. Liquid chamber 314 is also coupled to a liquid receptacle (not shown) via a check valve (not shown) and a liquid exit aperture 328.

As noted hereinabove in connection with FIG. 1, apertures 320, 324, 326 and 328 are preferably constructed so as to minimize wear on flexible partition 310 and thus may comprise, for example, a plurality of holes or an opening covered with a suitable mesh which prevents cutting of the flexible partition 306 on the peripheral edges of the respective apertures.

Figure 3:
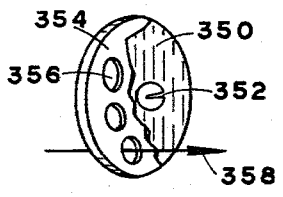
FIG. 3 is a perspective view, with parts broken away, of a one way valve, useful in embodiments of the invention.

FIG. 3 illustrates one possible embodiment of a one-way valve which could be employed in the embodiment of FIG. 1 to serve as valve 114 or 208. A membrane 350 preferably formed of a film material having non-communicating pores, is attached by means of a fastener 352 to a perforated disc 354 typically formed of a plastic material such as Teflon. The illustrated device is sealingly mounted across a opening or channel in an orientation such that the membrane faces in the direction of permitted fluid flow and the perforated disc faces in the direction of prohibited fluid flow.

It can be seen that the flow through the holes 356 in the permitted direction illustrated by arrow 358 is effected through bending of membrane 350. The flow in the opposite direction, however, does not occur since the corresponding pressure gradient causes membrane 350 to sealingly engage disc 354, thus preventing liquid flow through apertures 356.

Figure 5:
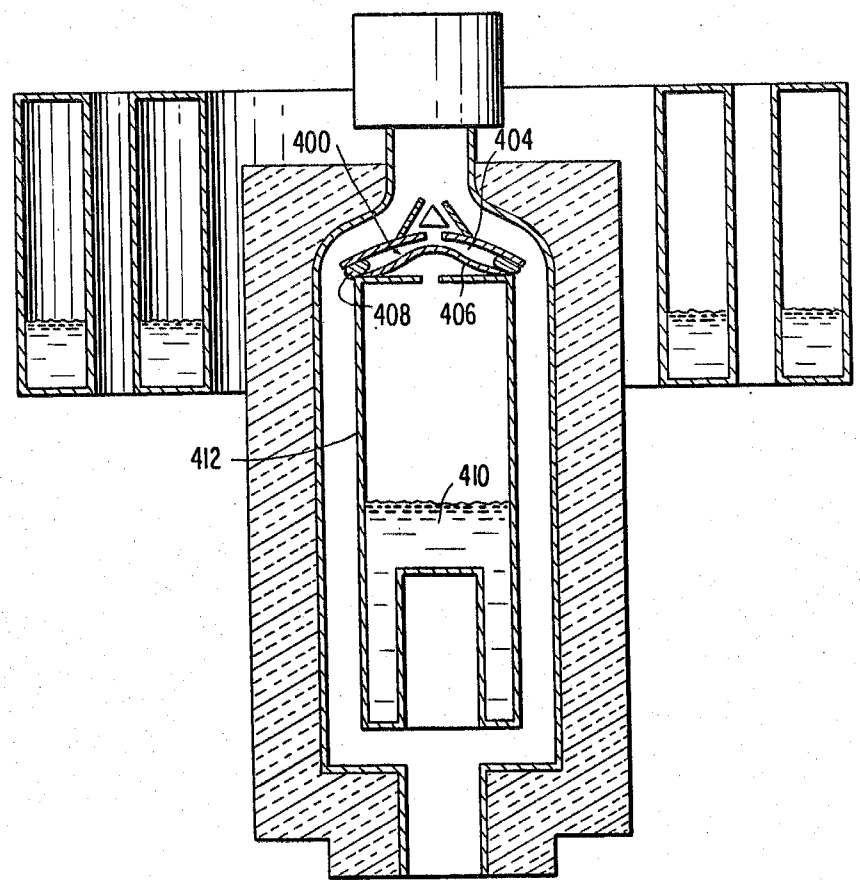
FIG. 5 is a schematical cross-sectional view of the pump shown in FIG. 4 taken along A—A.
Figure 4:
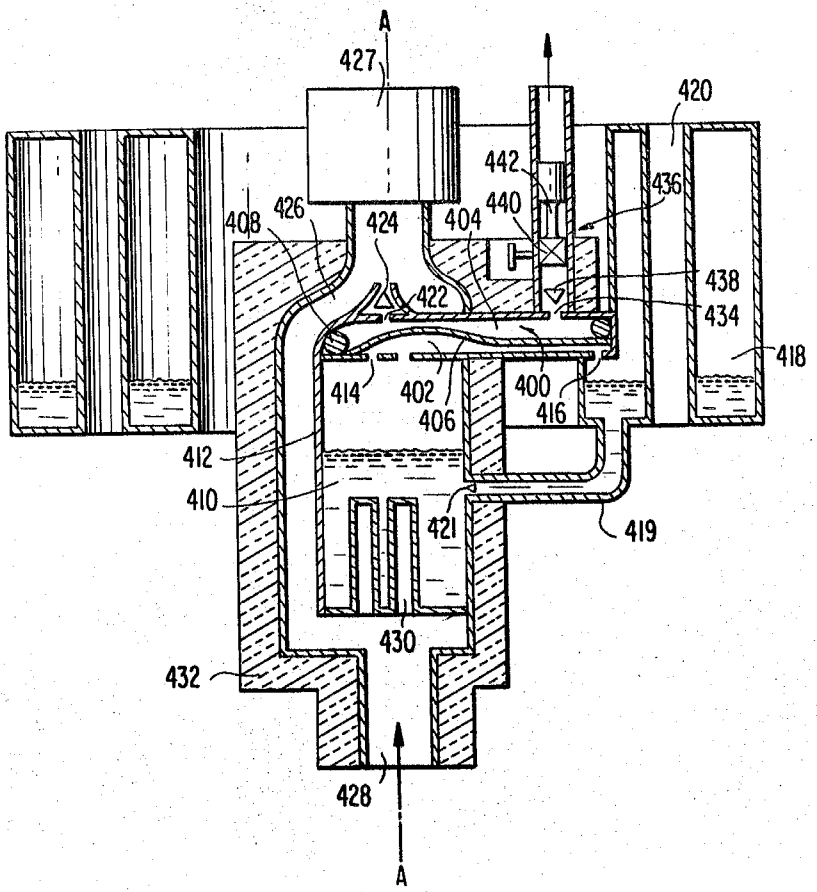
FIG. 4 shows schematically a longitudinal sectional view of a pump according to the present invention, designed to circulate hot liquid, in which the pumped liquid is also the required source of heat, the ambient air being the sink.

Reference is now made to FIGS. 4 and 5 which illustrated a heat-operated pump constructed and operative in accordance with an embodiment of the invention which utilizes the heat of the pumped liquid to provide pumping action.

A pumping chamber, identified generally by reference numeral 400, is divided into first and second chambers 402 and 404 of variable relative volumes, by means of a flexible partition 406. Partition 406 is sealed about its periphery by means of a sealing ring 408 in engagement with the wall portions defining the chamber 400, thus sealingly separating first and second chambers 402 and 404.

A fluid 410 having predetermined characteristics is provided in a boiler 412. Fluid 410 is selected to have a saturated vapor pressure at the temperature of the liquid to be pumped which is above the sum of the static pressure of the liquid and the additional pressure required to circulate it in the particular system being employed. Fluid 410 is also selected such that its saturated vapor pressure at ambient temperature lies below the pressure of the liquid entering the pump.

For example, if the liquid to be pumped is water at atmospheric pressure and at 60° C. and the additional pressure required for circulation is 0.1 atmospheres, and the ambient temperature is below 40° C., a fluid boiling at sea level at about 50° C., for example, petroleum ether, glyoxal, 2-pentyne, will preferably be introduced into boiler 412.

Chamber 402 is formed with an inlet aperture 414 communicating with the interior of boiler 410, and an outlet aperture 416 communicating with the interior of a condenser 418. Condenser 418 communicates with boiler 412 for the purpose of return of the condensate to the boiler via a conduit 419 and one-way valve 421. Condenser 418 is provided with a plurality of air passages 420 through which ambient air is permitted or caused to pass, thus effecting condensation of the vapors created by heating fluid 410.

Second chamber 404 is formed with an inlet aperture 422 which communicates via a one-way valve 424 with a liquid supply pathway 426. Pathway 426 extends alongside at least a portion of the side and bottom walls of boiler 412 and in heat conducting relationship therewith so as to effect heating of liquid 410. Liquid to be pumped enters passageway 426 at an inlet 428 from a suitable liquid source.

Boiler 412 may be configured with a number of hollow recesses 430 which may be filled with the liquid being pumped and which, due to their relatively large surface area, increase the speed and efficiency of heating the fluid 410. In order to help preserve the heat provided by the liquid being pumped and supplied to inlet 428, an enclosure 432 formed of a thermally insulative material is disposed substantially surrounding pathway 426, boiler 410 and most of pumping chamber 400. Liquid pathway 426 is formed with an air trap 427 which may be a conventional ball float trap suitable for venting gases while preventing the ingress of atmospheric air to the system.

Portion 404 is also provided with an exit aperture 434 which communicates along an exit path 436 and via a one-way valve 438 with a liquid container (not shown) for receiving the pumped liquid. According to a preferred embodiment of the invention, exit path 436 may also include a manually controllable valve 440 for controlling the outflow through path 436 and alternatively or additionally, an automatic flow stabilizer 442 which governs the rate of flow therethrough in response to the sensed pressure.

Apertures 414, 416, 422 and 434 are typically covered with a grid or defined by a plurality of small holes so as to minimize possible damage to flexible partition 406.

Manually operated valve 440 may conveniently be employed in the context of a circulating fluid heating system as a temperature regulator. Accordingly, flow stabilizer 442 may provide an automatic temperature regulating function.

One way valve 421 is operative to permit the flow of condensate from condenser 418 into boiler 412 only when the pressure of the condensate in conduit 419 adjacent valve 421 exceeds, by a predetermined amount corresponding to the hydrostatic pressure of the condensate, the pressure in boiler 412. Thus the valve 421 opens when flexible partition 406 is positioned so as to permit fluid communication between boiler 412 and condenser 418 through the first portion of pump chamber 400.

According to an alternative embodiment of the invention not illustrated herein, for the purpose of limiting the amount of vapour passing to the condenser, conduit 419 may be extended to traverse the interior of boiler 412 and to open adjacent aperture 414. According to this embodiment, the portion of conduit 419 which lies above the normal liquid level of fluid 410 in boiler 412 is provided with a plurality of narrow peripheral holes. When flexible partiion 406 permits communication between aperture 414 and the condenser 418, the pressure inside conduit 419 temporarily drops relatively quickly to approximately the pressure in the condenser and thus condensed fluid flows through valve 421 to the extension of conduit 419. Vapor produced in the boiler then enters conduit 419 through the narrow holes increasing the pressure inside the conduit up to the pressure in the boiler due to the fact that in the interval partition 406 closes apertures 414. Since backflow of the condenser fluid is prevented by one-way valve 421, the fluid gradually fills up the conduit up to the level of the narrow holes and then flows into the boiler.

The operation of the pump illustrated in FIGS. 4 and 5 will now be briefly summarized. Prior to operation of the pump, air is removed from boiler 412 and condenser 418 so as to provide a desired vacuum in the system. Inlet 428 is coupled to a source of hot liquid and the passageway 426 between boiler 412 and enclosure 432 is substantialy filled with the liquid to be pumped. Fluid exit passageway 436 is coupled to means for receiving the pumped liquid. The liquid 410 situated in boiler 412 becomes heated by the liquid to be pumped passing through passageway 426. When fluid 410 reaches a vapor pressure higher than the sum of the static pressure of the liquid to be pumped and the pressure required to circulate it, the pump begins to work generally similarly to the operation of the pump illustrated in FIG. 1 hereinabove.

There are three basic differences between the pump illustrated in FIG. 1 and that illustrated in FIGS. 4 and 5. Firstly, in the embodiment illustrated in FIGS. 4 and 5 the source of heat is the pumped liquid itself circulating alongside the boiler. Secondly, the condensate is returned directly to the boiler via conduit 419 instead of via the pumping chamber as in the embodiment of FIG. 1. Thirdly, means are provided for controlling the liquid flow at the outlet of the pump in the embodiment of FIGS. 4 and 5 and similar means are not provided in the embodiment of FIG. 1. It is appreciated that the embodiment of FIG. 1 could be modified to include any or all of the features shown in the embodiment of FIGS. 4 and 5.

Reference is now made to FIGS. 6 and 7 which illustrate embodiments of a flow stabilzer device constructed and operative in accordance with an embodiment of the invention. FIG. 6 shows in section a fluid passageway defined by a generally cylindrical outer housing 500 having disposed therewithin an expandable nozzle 502 formed of a foam material having noncommunicating pores. Nozzle 502 has defined therethrough an axial fluid flow passageway. The diameter of the fluid flow passageway thus defined varies as a function of the input pressure as a result of the fact that the foam material tends to be squeezed axially by such pressure resulting in the deformation and displacement thereof radially outward thus enlarging the fluid flow passageway.

According to an alternative embodiment of the invention, the fluid flow passageway may additionally comprise a central rod 503 disposed axially of nozzle 502 and secured at its extrme ends to housing 500.

The flow stabilizers as described hereinbefore are operative for maintaining a generally constant flow rate for a given temperature notwithstanding variations within given limits in the static pressure of the fluid to be pumped.

It is appreciated that the use of a heat operated pump as disclosed herein provides automatic regulation of flow as a function of temperature. This feature is extremely useful in solar energy collector appliations where it is necessary to govern flow as a function of liquid temperature.

Referring now to FIG. 7 there is seen an alternative type of flow stabilizer comprising a housing 520 and an inner generally annular member 522 having perforations 528 formed in the sidewalls thereof and a partition 526 preventing axial fluid flow therethrough. Disposed intermediate housing 520 and conduit 522 is an annular layer of foam material having non-communicating pores. The direct passage of liquid in the axial direction indicated by arrow 524 through conduit 522 is prevented by partition 526. Therefore, fluid entering conduit 522 passes through apertures 528 formed in the walls thereof and flows between conduit 522 and foam annulus 523 to apertures 529 beyond partition 526 via which it returns to conduit 522. It is appreciated that increased fluid pressure on annular foam layer 523 deforms the film layer so as to increase the mean cross-sectional area of the flowpath defined between the foam layer 523 and the outer walls of conduit 522.

Reference is now made to FIG. 8 which shows a pump constructed and operative in accordance with an embodiment of the invention and particularly suited for circulating a liquid through a heater or cooler and in which the pumped liquid operates both as a heat source and a heat sink.

Referring now to FIG. 8 there is shown a pump constructed and operative in accordance with an embodiment of the invention in which the pumped liquid serves as a heat source when at a first temperature and also serves as a heat sink when at a second temperature. This pump is particularly useful for circulation of a liquid through a heater or a cooler wherein the temperature gradient required for operation of the pump is provided. The pump, which is indicated generally by reference numeral 600, comprises a housing 601 which defines a pumping chamber 602. Disposed within pumping chamber 602 is a piston 603 which moves up and down along a longitudinal axis 605. Off axis motion of piston 603 is generally prevented by the provision of radially extending respective upper and lower fins 609 and 607. Pumping chamber 602 is divided into respective upper and lower portions 611 and 613 by means of a peripheral rolling diaphragm 615 having an inner rim sealingly attached to piston 603 and an outer rim sealingly attached to the inner peripheral wall of pumping chamber 602. It is thus appreciated that movement of piston 603 in chamber 602 varies the relative volumes of respective upper and lower portions 611 and 613.

Piston 603 is constructed, in accordance with the illustrated embodiment of the invention, to comprise an inner cylinder 618 and an outer cylinder 620 of greater radius than cylinder 618. A cylindrical recess 625 is formed in cylinder 618 generally coaxially therewith and an annular recess 622 is defined in cylinder 620 intermediate cylinder 618 and a cylindrical wall 626.

The lower portion 613 of pumping chamber 602 communicates with the interior of a boiler 617 via an opening 619. Boiler 617 contains a fluid 680 having predetermined characteristics, hereinafter termed "the driving fluid". Opening 619 is selectably opened or closed by a valve 621 comprising a sealing head member 623 disposed within boiler 617 and a stem 629 having disposed thereon radially extending fins 624 to guide the stem in up and down movement along axis 605 in cylindrical recess 625 formed within piston 603. Housing 601 is formed of heat insulative material particularly in the vicinity of the boiler.

A condensor 631 is coupled by a conduit 633 and a channel 635 to the lower portion 613 of pumping chamber 602. Conduit 633 communicates with condenser 631 at a location in the upper part of the condenser. A conduit 637 interconnects the bottom of condenser 631 to lower portion 613 of pumping chamber 602 via a channel 639. Channels 635 and 639 are disposed with respect to rolling diaphragm 615 such that access from the respective channels to lower portion 613 of chamber 602 is governed by the position of the rolling diaphragm.

The upper portion 611 of pumping chamber 602 and condenser 631 are separated by means of a second rolling diaphragm 640 having an inner rim sealingly attached to the outer wall of cylinder 618 of piston 603 and having an outer rim sealingly attached to the inner wall of a generally cylindrical volume 643.

An inlet port for liquid to be pumped opens into a volume 647 intermediate boiler 617 and housing 601.

Volume 647 communicates via a conduit 649 to an exhaust aperture 651 which is normally sealed with a plug or coupled to an air trap. A one-way valve 653 is located in fluid communication with conduit 649 at the inlet to upper portion 611 of chamber 602 and permits the flow of liquid from conduit 649 into chamber 602. A liquid exit opening 660 through which the pumped liquid leaves pump 600 is coupled via a one-way valve 661 through upper portion 611 of chamber 602.

Condenser 631 comprises a heat exchanger 663 having respective inlet and outlet ports 665 and 667 for a cooling liquid. It may be appreciated that during operation of the pump the lower portion 613 of pumping chamber 602 becomes filled with vapor generated in boiler 617 while the upper portion 611 of chamber 602 becomes filled with the pumped liquid which also serves to heat the liquid in boiler 617. The upper end of piston 603 defined by cylinder 618 and on which the condensed driving liquid in volume 643 presses, has a smaller cross-sectional area than the corresponding lower end of piston 602 defined by cylinder 620, and on which the vapour generated in boiler 617 presses. The pumped liquid exerts pressure on an area equal to the difference between the cross-sectional area of cylinder 620 and that of cylinder 618. Pressure is exerted by the saturated vapour contained within the condenser and the pumped liquid in the same direction and opposite to the pressure exerted by the vapour produced in the boiler. It can be seen that the pistons operate as a pressure multiplier and therefore the driving pressure produced in the boiler need not be higher than the pressure of the pumped liquid.

The driving fluid employed in the boiler-condenser system is selected such that its saturated vapour pressure at a temperature lower than the temperature of the liquid to be pumped acting on the bottom of piston 603 is sufficient to raise the piston against the pressure upon piston 609 exerted by the saturated vapour in the condenser, and the static pressure of the liquid to be pumped in addition to the pressure required to circulate the pumped liquid. Furthermore, the saturated vapour pressure of the driving liquid at a temperature higher than the temperature of the cooling liquid, but lower than the first temperature described hereinabove, must be sufficiently low such that when such pressure acts on respective cylinders 620 and 618 in opposite directions, the piston moves downwards under the static pressure of the pumped liquid.

Thus, when the temperature of the liquid to be pumped, its static pressure, the pressure required to circulate it and the temperature of the cooling liquid are known, the driving liquid 680 for circulation through the boiler and condenser may be selected accordingly.

The following example may illustrate the selection of workable parameters:

| | |
|---|---|
| Liquid to be pumped | Water at one atmosphere (absolute) and at 60° C. |
| Additional pressure required to the pumped liquid | 0.1 atmospheres |
| Temperature of the cooling liquid | 20° C. |
| Ratio of cross-sectional area of piston cylinders 609 and 620 | 9:10 |
| Driving liquid | Water |
| Temperature lower than the temperature of the liquid to be pumped | 55° C. (first temperature) |
| Temperature higher than the temperature of the cooling liquid | 25° C. (second temperature) |
| Saturated steam pressure at first temperature | 0.16 atmospheres (absolute) |
| Saturated steam pressure at second temperature | 0.03 atmospheres (absolute) |
| Force acting outwards on the piston at first temperature | α(force at first temperature) × (cross-section of cylinder 620) − (force at second temperature (in condenser)) × (cross-sectional area of cylinder 609) α0.16 × 10 − 0.03 × 9 α1.33 |
| Force acting downwards on the piston | α(static pressure of liquid to be pumped + additional pressure required to circulate liquid) × (difference between the cross-sectional areas of respective cylinders 620 and 618) α1 × 1.1 = 1.1 |
| Results | Piston rises |
| When the saturated steam pressures are equilibrated at lower temperature by venting to condenser the following parameters apply: | |
| Force acting upwards | (0.03 × 10)−(9 × 0.03) = 0.03 |
| Force acting downwards | 1 × 1 = 1 |
| Result | Piston moves downwards |

The operation of the pump illustrated in FIG. 8 hereinabove described will now be summarized. It is appreciated that it is necessary for the source of heated fluid to be pumped to lie below the pump in order that the liquid in the vicinity of boiler 617 may be maintained in a heated condition by convection from the lower lying source of heated fluid. This is true also for the embodiment illustrated in FIGS. 4 and 5.

Prior to operation of the pump air must be substantially expelled from both the boiler and condenser. Inlet port 645 is coupled to a source of a liquid to be pumped. The liquid to be pumped enters via inlet port 645, flows alongside boiler 617 in volume 647 and then passes into the upper portion 611 of chamber 602 via conduit 649 and one-way valve 653. Initially volume 647 duct 649 and upper portion 611 of chamber 602 are filled with the liquid to be pumped. This filling may occur under the influence of the vacuum initially provided.

Outlet port 660 is coupled to a conduit to be supplied with liquid either directly or via a control device such as a manual or automatic valve or flow stabilizer as described hereinabove in connection with FIGS. 4–7. The inlet port 665 of the heat exchanger 663 is coupled to a source of a cooling liquid while outlet port 667 is coupled to a suitable conduit in accordance with the particular configuration of the apparatus in which the pump is employed. Two exemplary configurations employing a pump of the type described hereinabove will be illustrated and described hereinafter.

Heat from the fluid being pumped is transmitted to the fluid contained within the boiler. Once the vapor pressure of the boiler fluid 680 becomes sufficiently high, piston 603 rises, expelling the pumped liquid from the upper portion 611 of chamber 602 via one-way valves 661 and outlet 660. The vapor produced in boiler 617 and acting on the bottom of cylinder 620 of piston 603 progressively fills the lower portion of chamber 602. At the highest position of the piston, valve 621 is permitted to rise sufficiently so as to seal the aperture 619 leading from the boiler to the lower portion 613 of chamber 602. Simultaneously rolling diaphragm 615 is positioned so as to open communication between channels 635 and 639 on the one hand and the lower portion 613 of chamber 602 on the other hand, permitting escape of the vapor generated in boiler 617 into condenser 631 via conduit 633 and depending on the level of condensate in the condenser, possibly also via conduit 637. Additionally, the condensate collected in condenser 631 may flow back to boiler 617 via conduit 637, channel 639 and lower portion 613 of chamber 602. Such a flow will occur only after the pressures in portion 613 and in the condenser 631 become substantially equal. Once the pressure in the lower chamber drops sufficiently, the piston begins to move downwardly driven by the static pressure of the pumped liquid which enters the upper portion 611 of chamber 602 via one-way valve 653. As the piston moves downwardly, rolling diaphragm 615 seals channels 635 and 639. In the meantime, valve 621 remains in sealing association with aperture 619, maintained in the raised position by the vapour pressure in boiler 617. Thus, the pressure in the lower portion 613 of chamber 602 is not increased until piston 603 approaches its lowest position at a position slightly above the lowest position. The top of hollow cylinder 625 engages stem 629 of valve 621 pushing it downward and thus unseating valve 621 from aperture 619. Vapour produced in boiler 617 passes through aperture 619 and once again fills portion 613 of chamber 602, raising piston 603 as condensed fluid flows from chamber 602 via aperture 619 into boiler 617.

According to an alternative embodiment of the invention, channel 639 may be located lower than rolling diaphragm 615 so as to remain open independently of the position of the piston and thus of the diaphragm. In such a case conduit 637 is provided with a one-way valve only permitting flow therethrough from the condenser into portion 613 of chamber 602.

The pressure of the vapour within the pumping chamber may be controlled by suitably configuring the shaft of valve 621 along a portion of its length such that its cross-section nearly seals opening 617 at a predetermined piston height.

Reference is now made to FIGS. 9*a* and 9*b* which respectively illustrate in schematic form, heating and cooling cycles in which the pump illustrated in FIG. 8 may usefully be employed. The heating or cooling systems described hereinbelow may either be open to the atmosphere or sealed therefrom. In both figures reference numeral 700 indicates the pumping chamber of pump 600 (FIG. 8). Reference numeral 702 indicates volume 647 (FIG. 8) through which the liquid to be pumped passes while heating the liquid in the boiler and reference numeral 704 indicates heat exchanger 663 of condenser 631 (FIG. 8).

In the open heating system illustrated in FIG. 9*a* a cold liquid supplied by a source flows through heat exchanger 704 and then passes through a heater 706 wherein it is heated to a desired temperature. The hot liquid then enters volume 702 and passes through chamber 700 of the pump and is removed therefrom by the pumping action of the pump for external use and disposal.

In an alternative closed heating system (not illustrated) the heated liquid leaving chamber 700 of the pump operates as a heat conveying medium for a purpose such as heating of a building.

After having given up a part of its heat, the liquid is returned at a lower temperature to pass through heat exchanger 704 and be recycled through the system as described. In accordance with the arrangement described hereinbefore the pumped liquid operates both as the required heat sink and as the required heat source. Thus, the pump converts part of the heat transported by the liquid into the mechanical work required for pumping and does not extract from the system any additional quantity of energy aside from heat losses through the external wall of the pump, since the heat exchanger 704 operates as a pre-heater and any friction losses inside the pump effect heating of the liquid.

FIG. 9*b* illustrates an open cooling device in which the liquid to be cooled enters volume 702 thus heating the liquid in boiler 617. The liquid then passes through a chamber 700 where it is pumped through a cooler 708. The cooled liquid leaving cooler 708 flows through heat exchanger 704 and is then released for use and disposal.

In an alternative closed system the cooled liquid from cooler 708 flows through the exchanger 704 and then operates as a frigories conveying medium, for example, to cool a freezer. After having given up a part of its frigories, the liquid is returned at a higher temperature to volume 702 for recycling through the system.

In accordance with either of the alternative arrangements described hereinabove, the pumped liquid operates both as a required heat source and heat sink. Thus, the pump introduces frigories into the system since the frigories extracted by the condenser, added to those compensating for frictional losses inside the pump, are less in terms of the mechanical work done by the pump, than the frigories introduced into the liquid by the boiler. It is assumed here that the loss of frigories through the external wall of the pump is negligible.

Referring now to FIGS. 10, 11 and 12 there is shown a heat operated pump which was constructed and operated experimentally and is analogous in its operation to the pump illustrated and described hereinbelow in connection with FIG. 2. Generally planar upper and lower portions 802 and 804 are configured to have confronting generally identical elongated depressions 806 and 808 formed therein defining a pumping chamber 810. Upper and lower portions 802 and 804 are typically formed of a plastics material and either or both are formed with a peripheral groove 811 surrounding the confronting surface such that the portions 802 and 804 when joined together in mating relationship sealingly accommodate a sealing ring 812 which may be any suitable O-ring.

Pumping chamber 810 is divided into first and second portions by means of a flexible membrane 814 typically formed of Teflon which is configured to have a reversibly directionable indentation therein corresponding to the surface configuration of depressions 806 and 808.

The flexible diaphragm is mounted in sealing engagement between the upper and lower members 802 and 804 in association with O-ring 812. The thickness of the membrane is selected to provide desired threshold limits for reversing the direction of the indentation and was selected to be $75 \times 10^{-3}$mm in the experimental embodiment.

Depressions 806 and 808 are generally uniform along the majority of their lengths and have a cross sectional radius of curvature, in their experimental embodiment, of 57.25 mm and a length of approximately 145 mm.

Fluid inlet and outlet apertures 820 and 822 are formed in the upper member 802 and communicate with the second portion of the pumping chamber at locations centered with respect to the length of the pumping chamber and separated from each other by a distance of 112 mm (center-to-center) approximately.

Respective vapour inlet and outlet apertures 824 and 826 are formed in lower member 804 and communicate with the first portion of the pumping chamber at locations which are centered with respect to the length and width of the pumping chamber and separated from each other by a distance of approximately 126 mm (center-to-center).

It will be appreciated by persons skilled in the art that the various embodiments of the invention illustrated hereinabove are merely exemplary and that a wide variety of modifications, changes and combinations of the above illustrated embodiments may lie within the ability of those skilled in the art and without requiring the excercise of an inventive faculty. A few examples of such possible modifications follow: In FIG. 1, tank 119 may be constructed so as to maintain atmospheric pressure above the level of the fuel stored therein. Alternatively, pressure control means may be provided for supplying fuel from tank 119 at pressures greater than atmospheric pressures. Heat exchanger conduit 105 may be modified to permit heating of the liquid in boiler 101 by any suitable source of hot gases.

Clearly the pump illustrated generally in FIG. 1 may be used to move fluids other than fuel, for example, an emergency pump may be provided for operating rooms for circulation of blood employing conventional heat source and the ambient air as a heat sink.

The condensers of the various pumps illustrated hereinabove may be cooled with any suitable medium either liquid or gas.

In FIG. 2 hereinabove the flexible partition comprises a tube made of flexible material and sealed by means of a pair of sealing rings. Alternatively, the flexible material may be made of any other suitable material and may incorporate therewithin sealing means. For example, the partition may be formed of a sponge having non-communicating pores.

This invention is therefore limited only by the claims which follow.

I claim:

1. A heat operated pump comprising:

a boiler containing a driving fluid;

means for heating said driving fluid in said boiler;

condenser means;

a pumping chamber including a flexible partition sealingly disposed in said chamber to define first and second sealingly separated portions;

first inlet means defining a communication passage from the interior of said boiler to said first portion;

first exit means defining a communication passage between said first portion and said condenser means;

second inlet means providing a uni-directional flowpath from a source of fluid to be pumped to said second portion; and second exit means providing a uni-directional flowpath from said second portion to a fluid utilization location;

said pumping chamber, first exit means and flexible partition being configured together to define a valve permitting communication between said condenser means and said first portion only when the volume of said first portion exceeds a predetermined volume;

said condenser being maintained at a pressure less than the pressure of said fluid at said second inlet means.

2. A heat operated pump according to claim 1 wherein said means for heating said driving fluid includes means receiving heat from said fluid to be pumped.

3. A pump according to claim 1 wherein said condenser means includes means for transferring heat from said driving fluid to said fluid being pumped.

4. A heat operated pump according to claim 1 and also comprising means for governing the flow of fluid through said second exit means.

5. A heat operated pump according to claim 1 and also comprising flow stabilizing means governing the flow of fluid through said second exit means.

6. A heat operated pump according to claim 5 wherein said flow stabilizing means comprises:

a fluid flow channel having perforated walls defining inlet and exit portions separated by an impermeable partition;

resilient flexible material substantially surrounding said channel and arranged such that when said material is in a rest position a fluid flowpath is defined exterior of said channel from perforations in said inlet portion, along the outer wall of said channel and through perforations in the exit portion of said channel, and such that pressure exerted by said liquid pumped in a fluid flow direction causes said material to recede from the outer walls of said channel thereby widening said fluid flowpath.

* * * * *